US009210990B2

(12) United States Patent
Hoskins

(10) Patent No.: US 9,210,990 B2
(45) Date of Patent: Dec. 15, 2015

(54) MULTI-CHAMBER FLUID CONTAINERS

(71) Applicant: Matt Hoskins, Bend, OR (US)

(72) Inventor: Matt Hoskins, Bend, OR (US)

( * ) Notice: Subject to any disclaimer, the term of this patent is extended or adjusted under 35 U.S.C. 154(b) by 47 days.

(21) Appl. No.: 14/250,747

(22) Filed: Apr. 11, 2014

(65) Prior Publication Data

US 2015/0076180 A1 Mar. 19, 2015

Related U.S. Application Data

(60) Provisional application No. 61/878,412, filed on Sep. 16, 2013.

(51) Int. Cl.

| | |
|---|---|
| ***A45F 3/20*** | (2006.01) |
| ***B65D 81/32*** | (2006.01) |
| ***A61J 1/10*** | (2006.01) |
| *A45F 3/16* | (2006.01) |
| *A61J 1/20* | (2006.01) |
| *A45F 3/18* | (2006.01) |

(52) U.S. Cl.

CPC ... *A45F 3/20* (2013.01); *A45F 3/18* (2013.01); *A45F 2003/166* (2013.01); *A61J 1/2034* (2015.05); *A61J 1/2093* (2013.01); *B65D 81/3266* (2013.01)

(58) Field of Classification Search

CPC . A45F 2003/166; A45F 3/20; A65D 81/3266; A61J 1/2093; A61J 1/2034

USPC ..... 224/148.2, 148.6; 222/94, 129, 145.7

See application file for complete search history.

(56) References Cited

U.S. PATENT DOCUMENTS

| | | | | |
|---|---|---|---|---|
| 4,529,102 | A * | 7/1985 | Quinn et al. | 222/94 |
| 4,548,606 | A * | 10/1985 | Larkin | 604/414 |
| 4,608,043 | A * | 8/1986 | Larkin | 604/87 |
| 4,731,053 | A * | 3/1988 | Hoffman | 604/89 |
| 5,114,004 | A * | 5/1992 | Isono et al. | 206/222 |
| 5,207,509 | A * | 5/1993 | Herbert | 383/38 |
| 6,749,090 | B2 | 6/2004 | Bailey | |
| 7,156,132 | B2 * | 1/2007 | O'Dougherty et al. | 141/114 |
| 7,198,150 | B1 * | 4/2007 | Blaschke et al. | 206/221 |
| 7,428,771 | B2 * | 9/2008 | Fujii et al. | 24/543 |
| 7,533,786 | B2 * | 5/2009 | Woolfson et al. | 222/144.5 |
| 7,806,300 | B1 * | 10/2010 | Noell et al. | 222/175 |
| 8,201,711 | B2 * | 6/2012 | Tsai | 222/175 |
| 8,292,120 | B2 * | 10/2012 | LaFlamme et al. | 222/94 |
| 8,887,962 | B2 * | 11/2014 | Herivel et al. | 222/175 |
| 2004/0118942 | A1 * | 6/2004 | Courtney | 239/302 |
| 2007/0090135 | A1 * | 4/2007 | Benham | 224/148.2 |
| 2011/0162740 | A1 | 7/2011 | Tsai | |
| 2014/0001253 | A1 * | 1/2014 | Smith | 235/375 |
| 2014/0319150 | A1 * | 10/2014 | Flank et al. | 220/529 |

* cited by examiner

*Primary Examiner* — Justin Larson

(74) *Attorney, Agent, or Firm* — Klarquist Sparkman, LLP

(57) ABSTRACT

Embodiments of fluid containers are described that include a multi-chambered fluid bladder and a sealing mechanism for selectively sealing off different chambers from each other for independent use, such as for two different kinds of fluids, or opening to fluidly connect different chambers to each other to form larger chambers for a common fluid. Embodiments can further include independent fill ports and outlet ports for each chamber. The sealing mechanism can comprise a clip or latch that is configured to clamp the fluid passageway in the bladder closed. Some embodiments can include a removable handle that attaches to the bladder and includes the sealing mechanism.

16 Claims, 10 Drawing Sheets

MULTI-CHAMBER FLUID CONTAINERS

CROSS REFERENCE TO RELATED APPLICATION

This application claims the benefit of U.S. Provisional Patent Application No. 61/878,412, filed Sep. 16, 2013, which is incorporated by reference herein in its entirety.

FIELD

This application relates to fluid containers, and particularly to personal hydration systems, such as for sports, military, industrial use, and other uses.

BACKGROUND

Wearable personal hydration systems are used by athletes, recreationalists, workers, military personnel, and others, to provide convenient access to fluid while in action. For activities requiring more than a liter of fluid, for example, a soft-sided fluid reservoir carried in a backpack or waistpack is often used. Hydration systems such as this can consist of a pack and a soft-sided reservoir paired with a flexible drink tube ending in a closable mouthpiece. Fluid capacities for pack-mounted reservoirs typically range from 1 to 3 liters. They feature a sealable fill port and an exit port at the base of the reservoir which connects to the drink tube. Fill and exit ports can be integrated into the edge of the soft-sided reservoir or more commonly, sealably attached to the reservoir's flat top surface. The drink tube ends in a mouthpiece which can be activated by the user to initiate fluid flow.

Pack-mounted bladders can have a number of strengths in regards to providing fluid access for longer-term physical activity. The reservoirs can be light in weight, yet durable. With their soft sides they can be relatively comfortable to wear and they have the added benefit of collapsing flat when they are empty. Their collapsibility also helps minimize fluid sloshing. The mouthpiece can be tethered to the chest area for easy access and drinking can be largely hands-free.

While bladder-based hydration systems offer plenty of fluid to replenish long distance runners and cyclists, for example, single chamber bladders mean that only one kind of fluid can be carried at a time. If an athlete wishes to carry an electrolyte type fluid they either need to fill the bladder with electrolyte or carry it separately in a bottle or second hydration bladder.

SUMMARY

Embodiments of multi-chambered personal hydration systems for fluid replenishment are described that include a multi-chambered bladder and a sealing mechanism for selectively sealing off the chambers from one another or opening to unite chambers together.

Some embodiments comprise a soft-walled bladder comprising two fluid chambers and a fluid passageway that fluidly couples the two fluid chambers within the bladder, a sealing mechanism adapted to selectively open and close the fluid passageway, such that when the fluid passageway is open the two fluid chambers function as a single fluid chamber, and when the fluid passageway is closed the two fluid chamber function as two independent fluid chambers. The bladder can include a front bladder sheet and a rear bladder sheet that are sealed together around their perimeter, and a partitioning seam that extends between the chambers and seals the front and rear bladder sheets together from a first end of the bladder perimeter and termination point short of a second, opposite end of the bladder perimeter to form the fluid passageway between the termination point and the second end of the bladder. When the sealing mechanism is in the closed position, the sealing mechanism cooperates with the partitioning seam to fluidly isolate the two fluid chambers from each other.

The partitioning seam can comprise at least one opening that passes through both the front and rear bladder sheets to permit passage of the sealing mechanism through the opening.

The sealing mechanism can be adapted to be stored with the fluid container in a fixed position when the fluid passageway is open.

Each of the fluid chambers can have its own inlet port and its own outlet port to provide independent utility when the fluid passageway is closed.

In some embodiments, the sealing mechanism comprises a clip having a first jaw and a second jaw that are hingedly coupled at a hinged end and are selectively lockable together at a locking end. When the fluid passageway is closed, the clip is positioned with the hinged end at one side of the fluid passageway and with the locking end locked at an opposite side of the fluid passageway, and with the first jaw against a front wall of the bladder and with the second jaw against a rear wall of the bladder, such that the clip clamps the front and rear walls of the bladder closed to seal the fluid passageway. When the fluid passageway is open, the clip can be adapted to be stored with the hinged end of the clip passing through a first opening in a partial partitioning seam between the two fluid chambers and with the locking end passing through a second opening in the partial partitioning seam, with the first and second jaws clamped against the partial partitioning seam between the first and second openings, such that the clip is retained to the bladder with the fluid passageway open.

In some embodiments, the personal hydration system comprises a rigid handle that is removably attachable to the bladder, and wherein the sealing mechanism is part of the handle. The handle can attach to the bladder a first location near an upper end of the bladder, such as at the fill ports, and attaches to the bladder at a second location near the fluid passageway at lower end of the bladder.

In some embodiments, the sealing mechanism comprises a latch that is pivotable relative a fixed portion of the handle. The latch can be adapted to be stored in the fixed portion of the handle when the fluid passageway is in the open position.

In some embodiments, the latch can pivot about 360° relative to the fixed portion of the handle between an open position and a closed position. The fixed portion of the handle can be positioned on a front side of the fluid passageway and the latch can pivot from the front side of the fluid passageway to the rear side of the fluid passageway to the closed position such that the latch and the fixed portion of the handle clamp the bladder to seal the fluid passageway.

In some embodiments, the latch is coupled to the fixed portion of the handle via a pivot pin that passes through a slot in the fixed portion of the handle, and the pivot pin and latch are allowed to translate along the slot in a front-back direction of the bladder while the latch rotates between open and closed positions.

In some embodiments, the handle comprises an upper fixed portion positioned on a front side of the bladder and a lower fixed portion that extends through an opening in the bladder and is positioned along a rear side of the fluid passageway, and the latch is pivotable about 180° on the front side of the bladder between an open position wherein the latch is stored in the upper fixed portion of the handle and a closed position wherein the latch extends over the front side of the fluid passageway and locks with the lower fixed portion of the handle at a lower end of the fluid passageway to clamp the fluid passageway closed.

In some systems, the fluid chambers can be divided is such a way such that they have unequal sizes and volumes. For example, a bladder can be dividable into two fluid chambers have a 2-to-1 volume ratio. This can allow a user to carry a larger volume of one fluid and a smaller volume of a second fluid. Accordingly, the partitioning seam and sealing device can extend across the bladder in any direction or geometry that divides the bladder into discrete chambers.

The foregoing and other objects, features, and advantages of the disclosed technology will become more apparent from the following detailed description, which proceeds with reference to the accompanying figures.

DETAILED DESCRIPTION

Figure 1B:
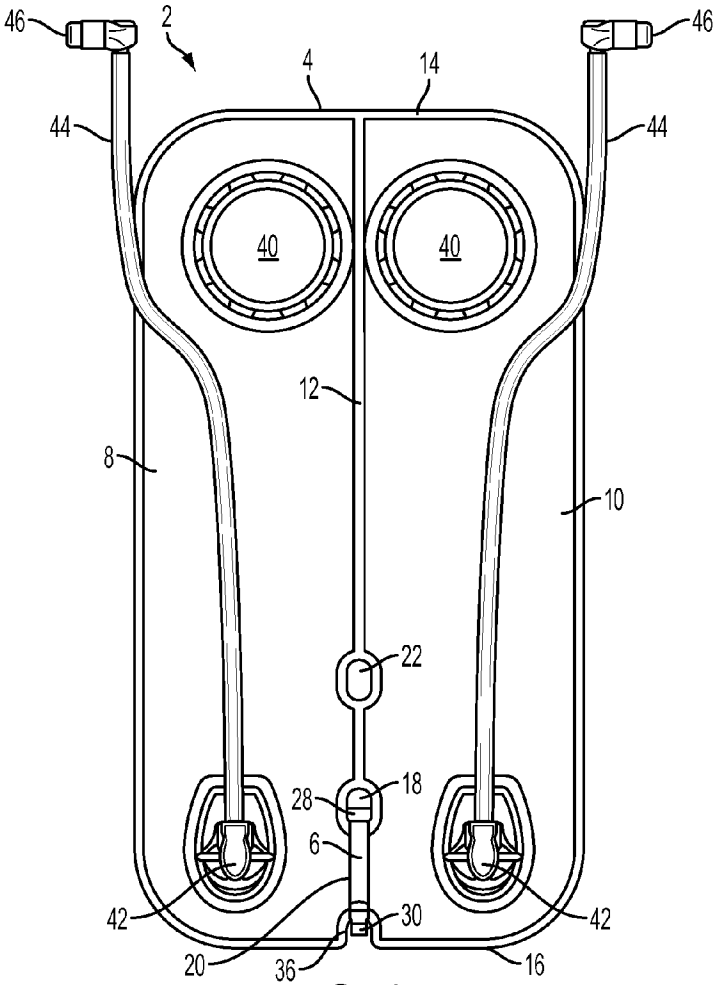
FIG. 1B is a front view of the fluid container of FIG. 1A, configured with the two chambers fluidly separated.

Exemplary embodiments personal hydration systems are described that include a multi-chambered fluid bladder and a sealing mechanism for selectively sealing off different chambers from each other or opening to fluidly connect different chambers to each other to form larger chambers. Embodiments can further include multiple filling and dispensing ports, and/or drink delivery conduits.

To eliminate the burden of carrying an extra bottle or bladder, disclosed hydration systems include a bladder with two or more chambers allowing a user to access more than one type of liquid. Multiple chambers may be created by layering chambers on top of one another. For example, a two chamber bladder can be constructed by welding three sheets of film together along their periphery. The bottom and middle sheets make up one chamber, while the middle and top sheet define a second chamber. An alternative method of creating a dual-chambered bladder is to divide a single chamber into two with a seam bisecting across the bladder. Multi-chambered bladders having more than two chambers can similarly be formed using two or more seams across the bladder. Combinations of layering and bisecting seams can also be used.

For either configuration, each chamber can have its own fill port and its own exit port. For the layered configuration described above, the respective ports may be attached to the exterior of the top sheet and to the exterior of the bottom sheet. Alternatively, in order to locate each set of ports on just one side of the bladder, the top sheet may be sealed to the middle sheet such that a portion of the middle sheet is exposed. In this case, one set of ports can be located in the top sheet while the other set of ports can be located on the exposed portion of the middle sheet. In embodiments with more than two chambers, additional sheets can be stacked and welded around their perimeters with each successive outer sheet being formed in the underlying sheet such that a portion of the underlying sheet is exposed to make room for ports in the chamber beneath the underlying sheet. For bladders with side-by-side chambers, the ports can simply be located over their respective chambers. Side-by-side multi-chambered bladders can be easier to manufacture, require less material, and can require fewer steps that stacked multi-layered, multi-chambered bladders.

Regarding fluid delivery, in some embodiments each chamber can include its own drink tube and optional mouthpiece extending from the respective exit ports. In other embodiments, a plurality of outlet tubes, one from each of the chamber exit ports, can be connected together at a valve system that allows switching between fluids from the different chambers and outlets the selected fluid to a single delivery tube and optional mouthpiece. In this case, the single delivery tube exits the valve system carrying whichever fluid was selected using the valve system. Some multi-chambered bladders feature a valve with two or more inflow ports and a single outflow port and a user controlled dial for selecting any proportion or combination of flow for the various fluids. Multi-chambered bladders that feature separate drink tubes and mouthpieces for each chamber can have the advantage of simplicity and instant access to each fluid type. Valved systems, on the other hand, can provide for one or more fewer drink tubes at the point of access and can offer the option of selective mixing of different fluids, such as water and an electrolyte.

While the fixed multi-chambered embodiments described above may be satisfactory in many aspects, adjustable multi-chambered embodiments disclosed herein can provide increased utility. One benefit of adjustable multi-chambered embodiments is increased versatility as to how the various chambers can be used independently or can be fluidly coupled together to form larger chambers. Adjustable multi-chambered bladders can be user-adjustable to serve as a single fluid bladder at times and as a multi-fluid bladder at others. For example, in some circumstances, a user may choose to carry a larger volume of only one type of fluid for a particular use. Rather than swapping out a multi-chambered bladder for a single-chambered bladder, an adjustable multi-chambered bladder, such as disclosed herein, can instead be used, wherein the adjustable multi-chambered bladder can be easily transformed such that two or more of its discrete chambers can be fluidly coupled together to function as a single, larger chamber.

In one example, a bladder with six chambers can have selectively openable and closable fluid pathways between the various chambers, such that it can be adjusted to have three groups of two chambers fluidly coupled together (acting as three independent chambers), or can be adjusted to have two groups of three chambers fluidly coupled together (acting as two independent chambers), or can be adjusted to have all six chambers fluidly coupled together (acting as one independent chamber), or can be adjusted to have two groups of two chambers fluidly coupled together along with two other non-coupled chambers (acting as four independent chambers), or can be adjusted to have any other combination of chamber groups. Any of the various mechanisms for selectively coupling and dividing chambers of a multi-chambered bladder that are described herein can be used in combination with any of the various different types of multi-chambered bladders described herein.

Another advantage of some adjustable multi-chambered bladders is ease of cleaning the bladder. Most bladders and other soft-walled hydration reservoirs require special care to maintain their cleanliness. For example, small port sizes can limit the ability to scrub and flush a bladder interior while the bladder's tendency to collapse can make it difficult for the bladder to fully dry. Such cleaning difficulty can be magnified for bladders having smaller chamber sizes, which is more likely with multi-chamber bladders. However, with the disclosed adjustable multi-chambered bladders, by virtue of fluid conduits between the chambers, cleanability is enhanced as the bladder interior can be flushed by streaming a cleaning solution in through one port in one chamber and out through another port in another chamber, optionally through other intermediate chambers. Similarly, drying of the bladder's interior is enhanced by virtue of enhanced air flow thru the multiple ports.

Some disclosed adjustable multi-chambered embodiments include a soft sided bladder with an interrupted that partially partitions the bladder into two chambers and an external sealing device that can be selectively employed to complete the interrupted seam between the chambers. Embodiments may also include distinct fill and exit ports for each chamber sealably attached to the bladder's front sheet. Fill ports are generally located towards the top of the bladder and the exit ports at the bottom. The fill ports can comprise any know type, such as face-mounted ports, in-seam ports, or open seams that are sealable in some fashion. The exit ports can rely on gravity flow and/or pressurization and can be located at or near the base of each chamber. The exit ports can comprise any know type, such as in-seam (edge) ports or face mounted ports, and can include a connection feature for attaching to a drink tube or other conduit. The exit ports can each be attached to a drink tube which terminates in one or more user activated mouthpiece. An in-line quick connect coupling may be connected to the drink tube between the mouthpiece and exit port. While many descriptions herein reference a two-chambered bladder, it should be appreciated that such bladders can be segmented into any number of chambers using a similar approach, and any number of the various chambers can be fluidly coupled together and/or sealed off from each other using similar technology.

The disclosed technology addresses a number of needs regarding hydration systems for carrying a two or more different fluids, such as water and an electrolyte fluid. Each of the fluids can utilize the infrastructure provided by the disclosed hydration systems for storage and delivery. Their containment in a soft-sided bladder can provide adequate volume capacity in a comfortably carried container. A side-by-side configuration for the bladder chambers can result in a relatively low-profile bladder for a better fit within a pack. Multiple drink tubes and mouthpieces can offer instant access to each fluid for users on-the-go. The ability to switch between a single chamber bladder and a multi-chamber bladder provides the user with a reservoir system that can be used in a variety of circumstances.

Figure 1A:
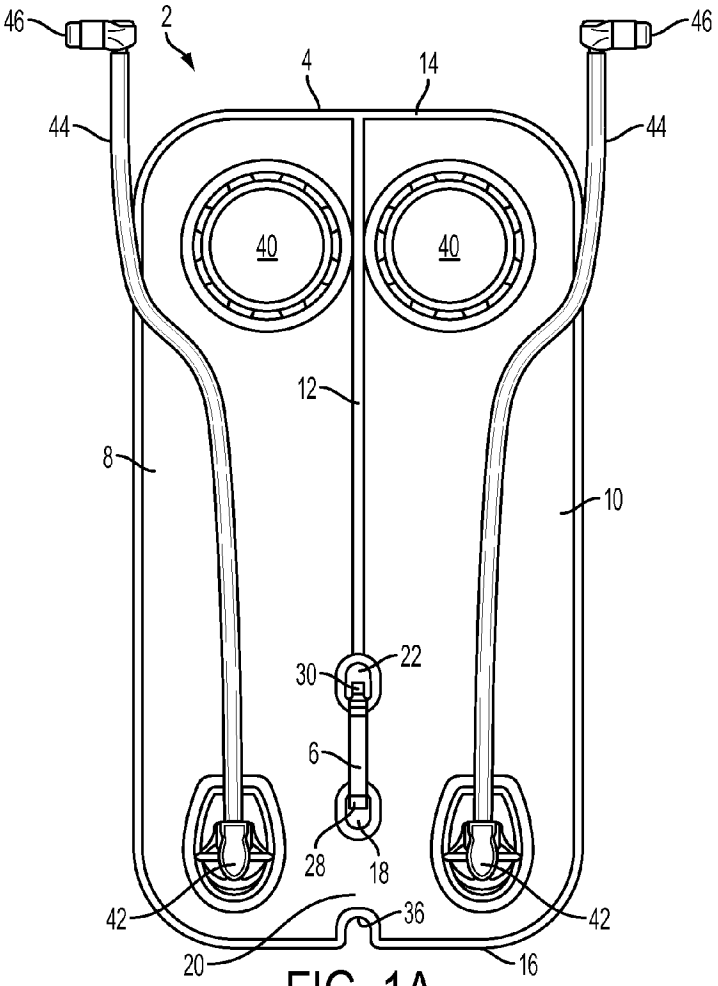
FIG. 1A is a front view of an exemplary fluid container having two fluid chambers, configured with the two chambers fluidly coupled.
Figure 2B:
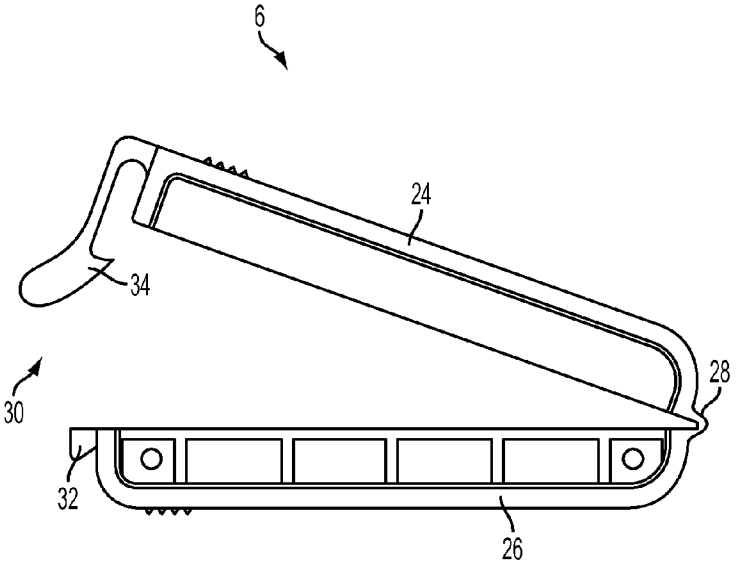
FIG. 2B shows the clip of FIG. 2A in an open position.
Figure 2A:
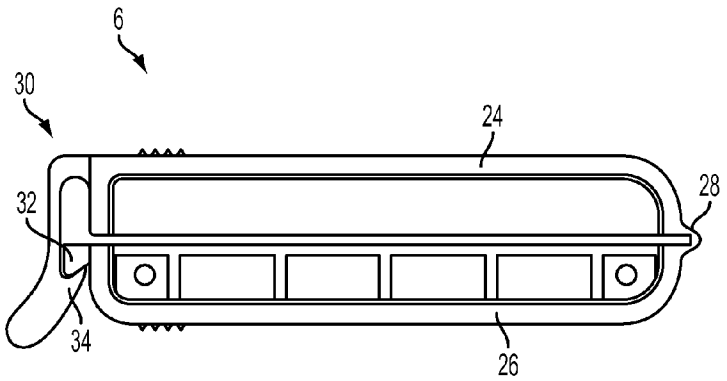
FIG. 2A shows an exemplary clip for use in separating the two fluid chambers of the fluid container of FIG. 1A, with the clip in a closed position.

An exemplary adjustable, multi-chambered fluid container 2 is shown in FIGS. 1A and 1B, which includes a bladder 4 and an external sealing clip 6 (an example of which is shown in detail in FIGS. 2A and 2B). The bladder 4 is partitioned into two chambers 8, 10 with a partitioning seam 12 that starts at the bladder's top edge 14 and runs nearly to its bottom edge 16. Where the partitioning seam 12 terminates, there is a first opening, or cut-out, 18 passing through the bladder that is distance from the bladder's bottom edge 16. The edges of the first cut-out 18 can be sealed and join the partitioning seam 12. An un-sealed fluid passage 20 in the bladder extends between the first cut-out 18 and a cut-out 36 in the bottom edge 16. The bottom cut-out need not be present in some embodiments. The passage 20 is of sufficient span to allow adequate flow of fluid between the adjoining chambers 8, 10.

Further up the partitioning seam 12 can be located a second cut-out 22 having a center-to-center distance from the first cut-out 18 of approximately the same distance as the distance from the bottom cut-out 36 to the of first cut-out 18.

The sealing clip 6 can comprise two lockable jaws 24, 26 that are hinged to one another at a hinged end 28 and have locking features 32, 34 at an opposite lockable end 30. As shown in FIG. 1B, the sealing clip 6 can be passed through the first cut-out 18 so that the jaws 24, 26 straddle the unsealed passage 20 of the bladder that is between the first cut-out 18 and the bottom cut-out 36. The jaws 24, 26 are of sufficient length such that the lockable end 30 of the clip extends past the passage 20 to the bottom edge 16 or bottom cut-out 36 when the sealing clip's hinged end 28 is located in the first cut-out 18.

In some embodiments, the opposing faces of the jaws 24, 26 can feature a tongue and groove arrangement that seals the bladder walls at the passage 20 when the jaws are pressed together in the locked position (FIG. 2A). The locking features 32, 34 can be engaged to maintain pressure sufficient for sealing the bladder walls captured between the jaws 24, 26.

The sealing clip 6 may be removed from the bladder 4 entirely, or for convenient storage, the sealing clip can be locked over the portion of the partitioning seam 12 that runs between the first and second cut-outs 18, 22, as shown in FIG. 1A. In each of the positions shown in FIGS. 1A and 1B, the sealing clip 6 can optionally be rotated 180° in the plane of the bladder 4 such that the its ends 28 and 30 are switched, and/or the clip can be flipped such that its jaws 24, 26 are switched between the front and rear sides of the bladder.

To seal off the two chambers 8, 10 from one another, the user can position the clip 6 as shown in FIG. 1B, bringing the sealing clip jaws 24, 26 together in an opposing fashion and lock them closed (FIG. 2A) using the locking features 32, 34, thus completing the partitioning seam 12 across the fluid passage 20 (FIG. 1B). To open the fluid passage 20, the sealing clip 6 can be unlocked (FIG. 2B) so that they do not apply pressure on the passage 20.

Depending on whether or not the user chooses to deploy the sealing clip 6, the bladder 4 can serve as a single fluid bladder or a dual fluid bladder. In the single fluid mode, the sealing clip 6 is disengaged and the two chambers 8, 10 are in communication with one another. Fluid can be drawn from the bladder 4 via either of the exit ports 42 using either drink tube 44. The second drink tube 44 may be disconnected and its exit port 42 closed off if desired. In the dual-chamber mode, the sealing clip 6 is deployed (FIG. 1B) and two separate fluid chambers 8, 10 are created, each with its own fill port 40, exit port 42, and drink tube 44 assembly.

This technology can be used in bladders of various shapes and fluid capacity. Personal fluid containers or hydration reservoirs are typically shaped to fit either a backpack or waistpack. For backpack applications, the bladder 4 can be a vertically-oriented rectangular or oval shape, for example, with the dividing seam 12 running vertically down the bladder. For waistpack applications, the bladder 4 can be a horizontally-oriented shape.

In alternative embodiments, the bladder 4 can be partitioned to create any number of chambers and chamber shapes and sizes. Sealing clips, such the clip 6, can located to seal from partitioning seam to bladder edge or partitioning seam to partitioning seam. For most embodiments, it can be desirable that sealing clip is located such that fluid from one chamber can drain out of the exit port of another chamber when the sealing clip is open.

A sealing clip can be integrated into other structural features of a multi-chambered fluid container. For example, it can be desirable to equip the fluid container with a handle, as shown in the embodiments of FIGS. 3-9. In certain embodiments, the sealing clip interacts with the fluid container handle to facilitate sealing clip operation and storage.

Figure 3:
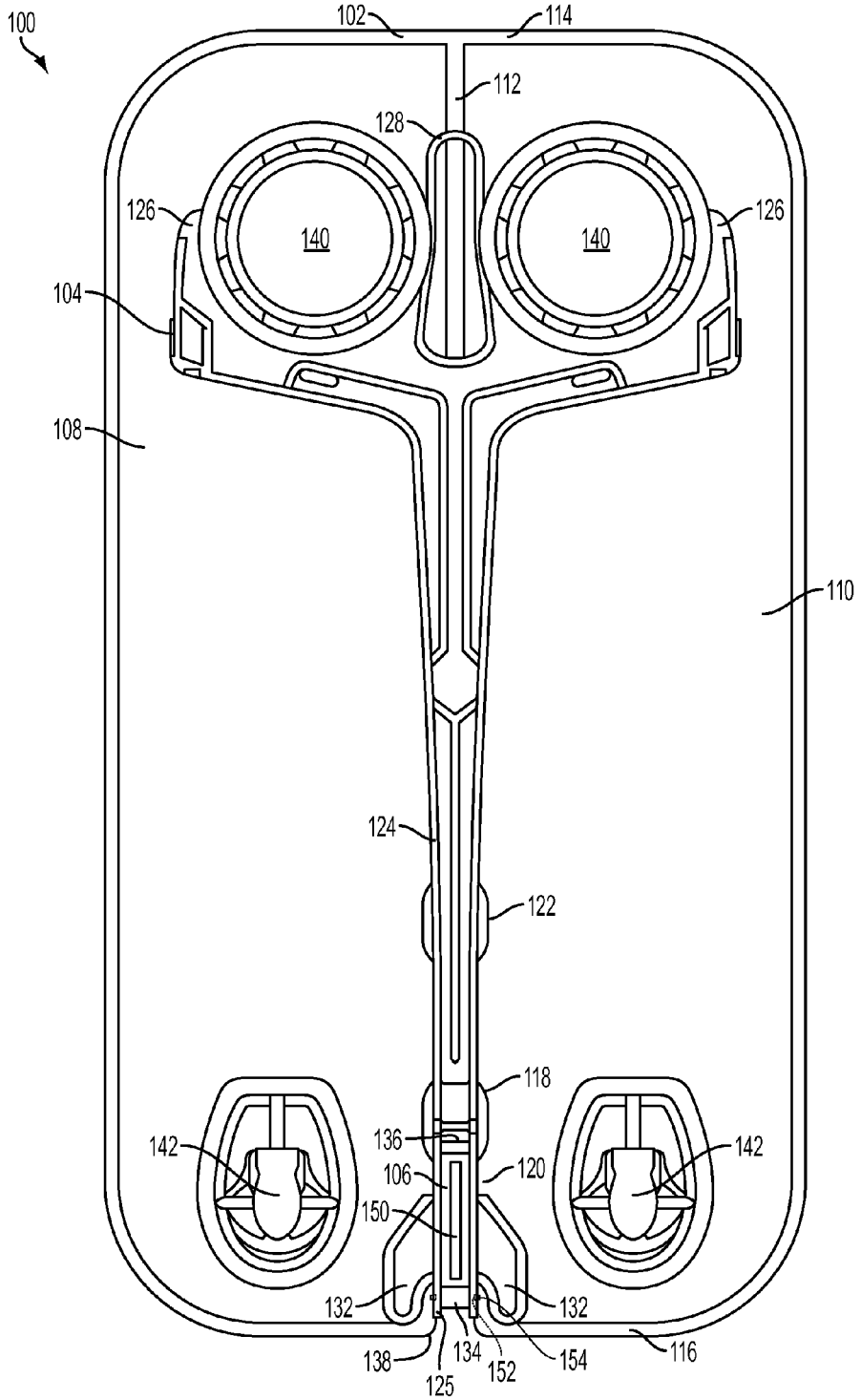
FIG. 3 is a front view of another exemplary fluid container having two fluid chambers, configured with the two chambers fluidly coupled.
Figure 4:
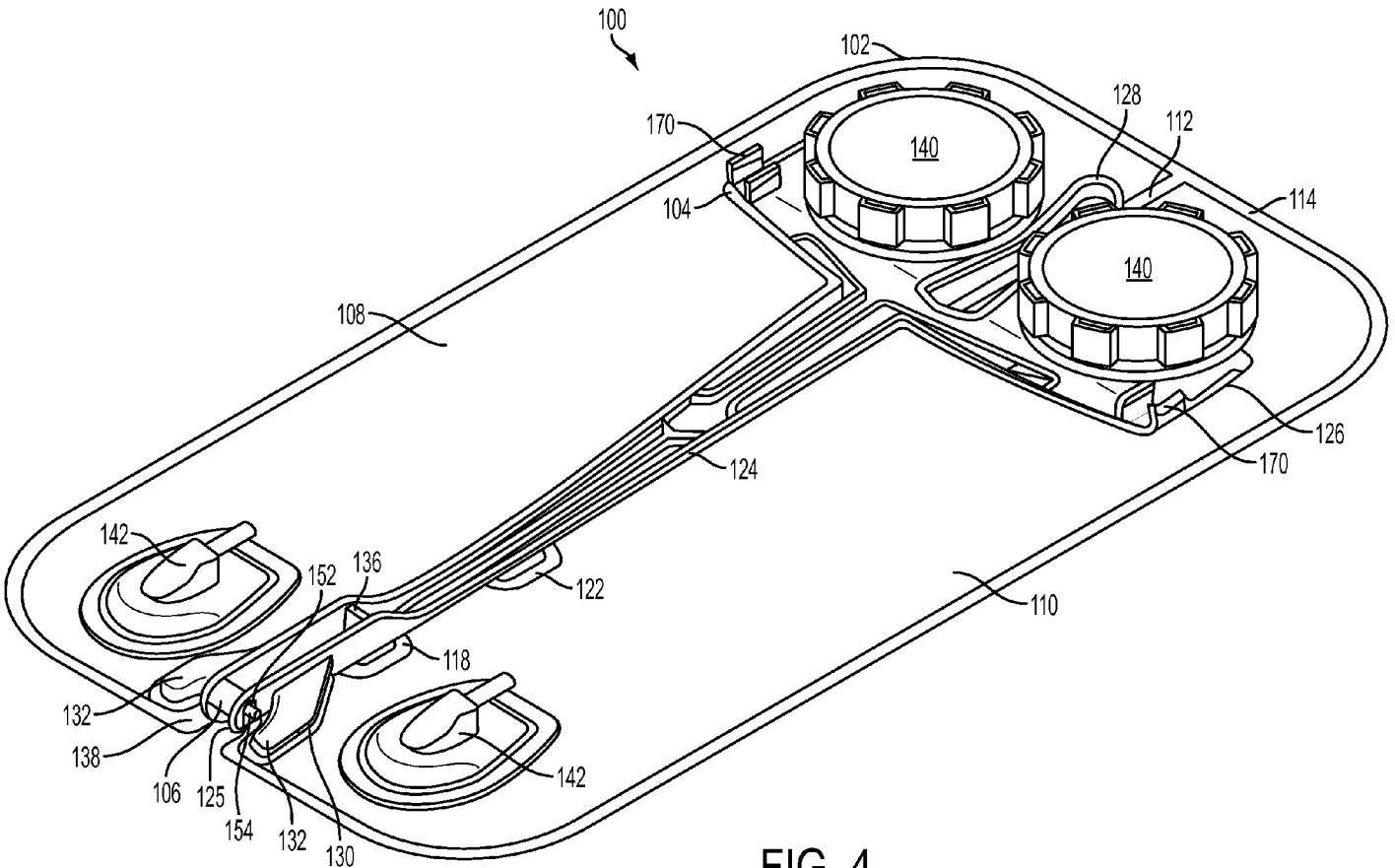
FIG. 4 is a perspective view of the fluid container of FIG. 3, configured with the two chambers fluidly coupled.

In the exemplary fluid container 100 of FIGS. 3-5D, a handle 104 is coupled to a bladder 102. The handle 104 can include a stem portion 124 that includes a pivotable sealing latch 106 for fluidly coupling and decoupling the two fluid chambers 108, 110 of the bladder. The handle 104 can attach to the bladder 102 at the fill ports 140, exit ports 142, and/or at brackets 132 located adjacent to the lower edge 116 of the bladder. As shown in FIGS. 3 and 4, the upper end of the handle 104 can include lateral arms 126 and a flexible medial arm 128 that cooperate to attach the top end of the handle to the fill ports 140. The lower end of the stem portion 124 of the handle can include flanges 130 or other engagement features that engage with brackets 132 attached to the front wall of the bladder near the bottom edge 116. The flanges 130 can slide downwardly into the brackets 132 to retain the lower end of the handle 104 to the bladder 102.

Figure 5A:
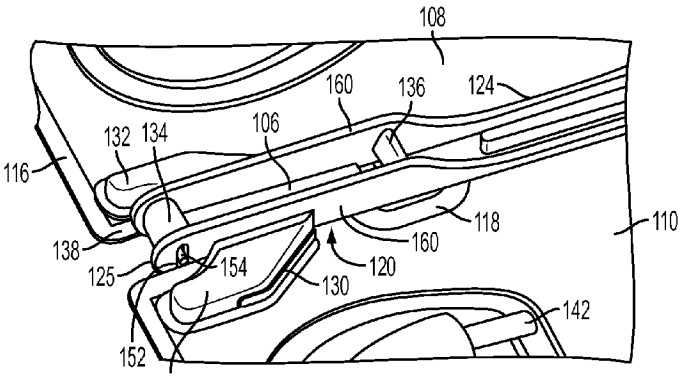
FIG. 5A is an enlarged perspective front view of the a latch mechanism of the fluid container of FIG. 3, with the latch in an open position.
Figure 5B:
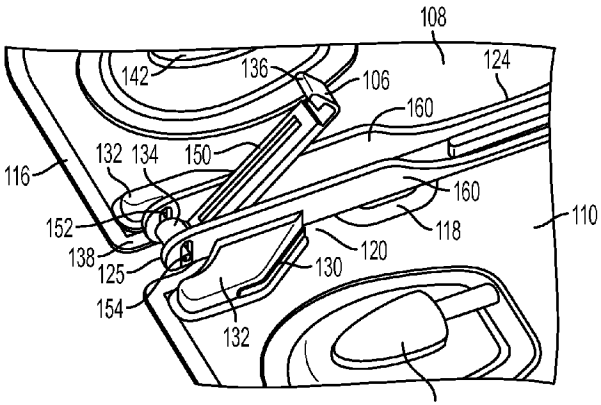
FIG. 5B shows the latch of FIG. 5A in a partially pivoted position.
Figure 5C:
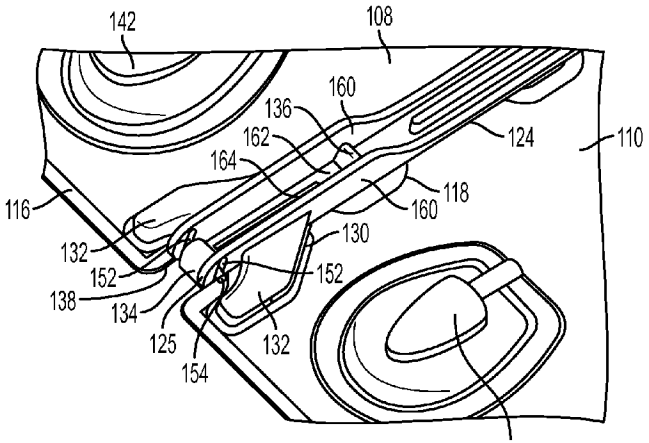
FIG. 5C shows the latch of FIG. 5A in closed position, pivoted about 360° from the open position of FIG. 5A.
Figure 5D:
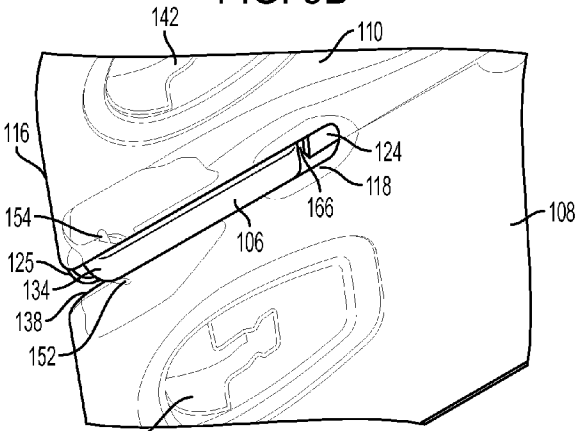
FIG. 5D is a perspective rear view of the fluid container shown the latch in the closed position of FIG. 5C.

The latch 106 can be pivotable nearly 360° between a fully open position (FIGS. 3, 4, and 5A) to a closed position (FIGS. 5C and 5D). As shown in FIGS. 5A-5C, the latch 106 has a free locking end 136 and a pivoting end 134 that is pivotably coupled to the bottom end 125 of the stem portion 124 via a pivot pin 154 that extends laterally through slots 152 in side walls 160 of the stem portion. The pivot pin 154 can translate along the length of the slots 152 to allow the latch freedom to translate in the front-back direction in addition to pivoting.

In the open position (FIGS. 3-5A), the latch 106 can be nested in the handle 104 above the unsealed passage 120 of the bladder between the two chambers 108, 110, allowing free fluid flow between the chambers. In the open position, the pivot pin 154 is positioned near front ends of the slots 152 to allow the latch to sit in front of the bladder 102.

In the closed position (FIGS. 5C-5D), the pivot pin 154 is near the rear ends of the slots 152 such that latch 106 sits behind the bladder 102 on the opposite side of the bladder from the handle 104, and the passage 120 between the two chambers becomes sealed between engaged surfaces of the latch and the handle. In the closed position (FIGS. 5C, 5D), the locking end 136 of the latch 106 can project through an opening 118 in the bladder between the lower end of the partitioning seam 112 and the upper end of the passageway 120 between the two chambers. The locking end 136 of the latch 106 extends upwardly through the opening 118 and engages with an opening 166 in the stem portion 124 to lock the latch in the closed position such that the passageway 120 is sealed closed and fluid cannot flow between the two chambers 108, 110. The latch 106 can include a ridge or groove 150 (FIG. 5B) that cooperates with a ridge or groove 164 in the stem portion 124 (FIG. 5C) to help seal the passageway 120 closed in the closed position.

The handle 104 can be removed from the bladder 104 when the fluid container 100 is used for a single fluid with the passageway 120 open, or the handle can be left attached with the latch 106 stored in the stem portion 124 in the open position. The fluid container 100 can also include fluid conduits and/or drink valves that are coupled to the exit ports 142. The handle 104 can optionally include retainers or other features 170 (FIG. 4) that can retain or hold the fluid conduits when not in use. The handle 104 can also be used and lift and carry the fluid container, and to secure the fluid container to a pack or other object.

FIGS. 6-9 show another exemplary fluid container 200 having a multi-chamber bladder 202 and a removable handle 204 that includes a pivotable sealing latch 206 for sealing a passageway 220 between the bladder's two chambers 208, 210. The handle 204 can include a stem portion 224 that supports the latch 206. The lower end of the stem portion 224 extends through an opening 218 in the bladder between the lower end of the partitioning seam 212 and the upper end of the passageway 220 between the two chambers, such that the upper portion 261 of the stem portion 224 is in front of the bladder and the lower end 262 of the stem portion is behind the passageway 220 in the bladder. The lower end 262 of the stem portion 224 serves as half of a clip to seal the passageway 220, with the latch 206 serving as the other half of the clip.

The handle 204 can attach to the bladder 202 at the fill ports 240 and at the lower end of the bladder as the stem portion 224 extends through the opening 218. The upper end of the handle 204 can include lateral arms 226 and a flexible medial arm 228 that cooperate to attach the upper end of the handle to the fill ports 240.

Figure 6:
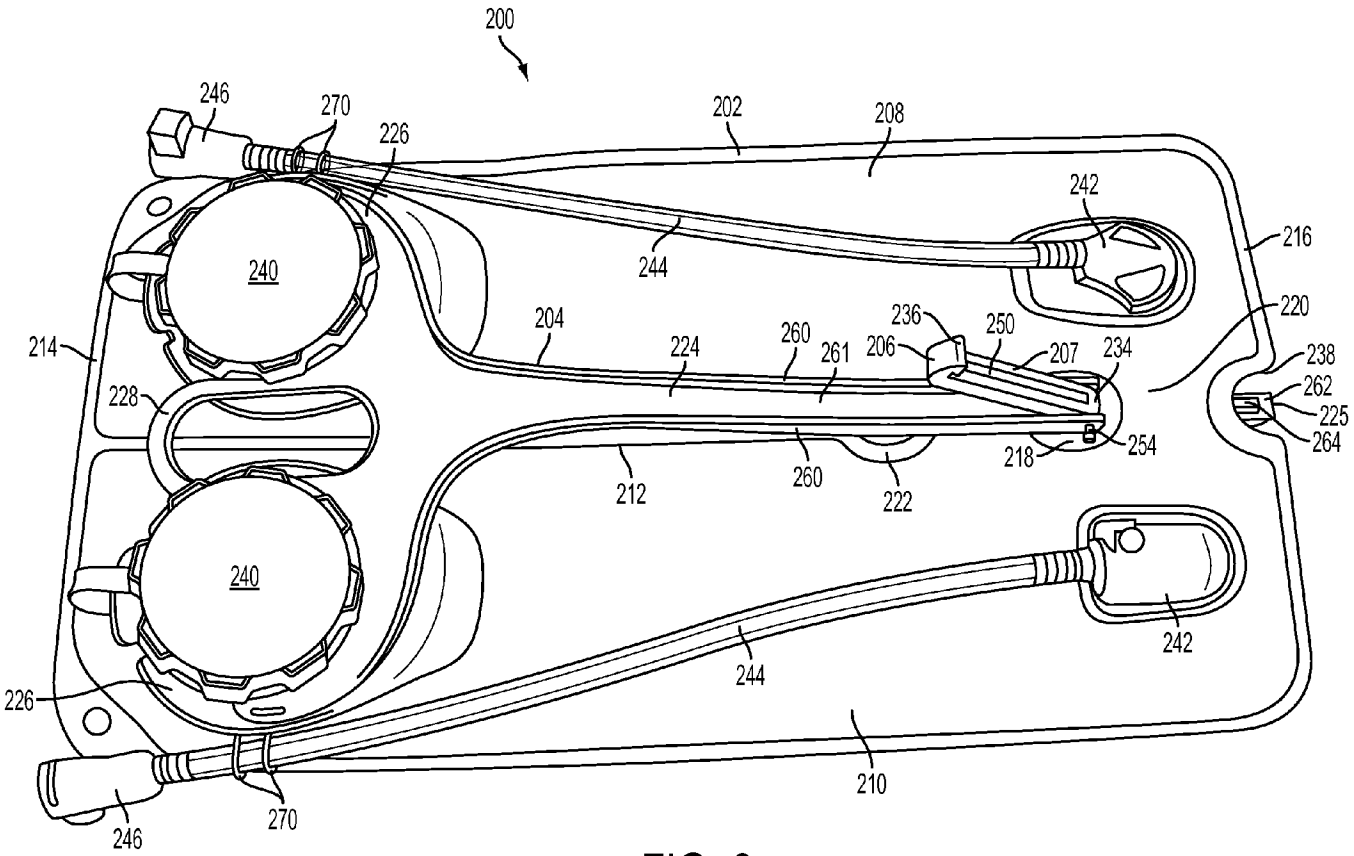
FIG. 6 is a perspective front view of another exemplary fluid container having two fluid chambers, configured with a latch in an open position and the two fluid chamber fluidly coupled.
Figure 7:
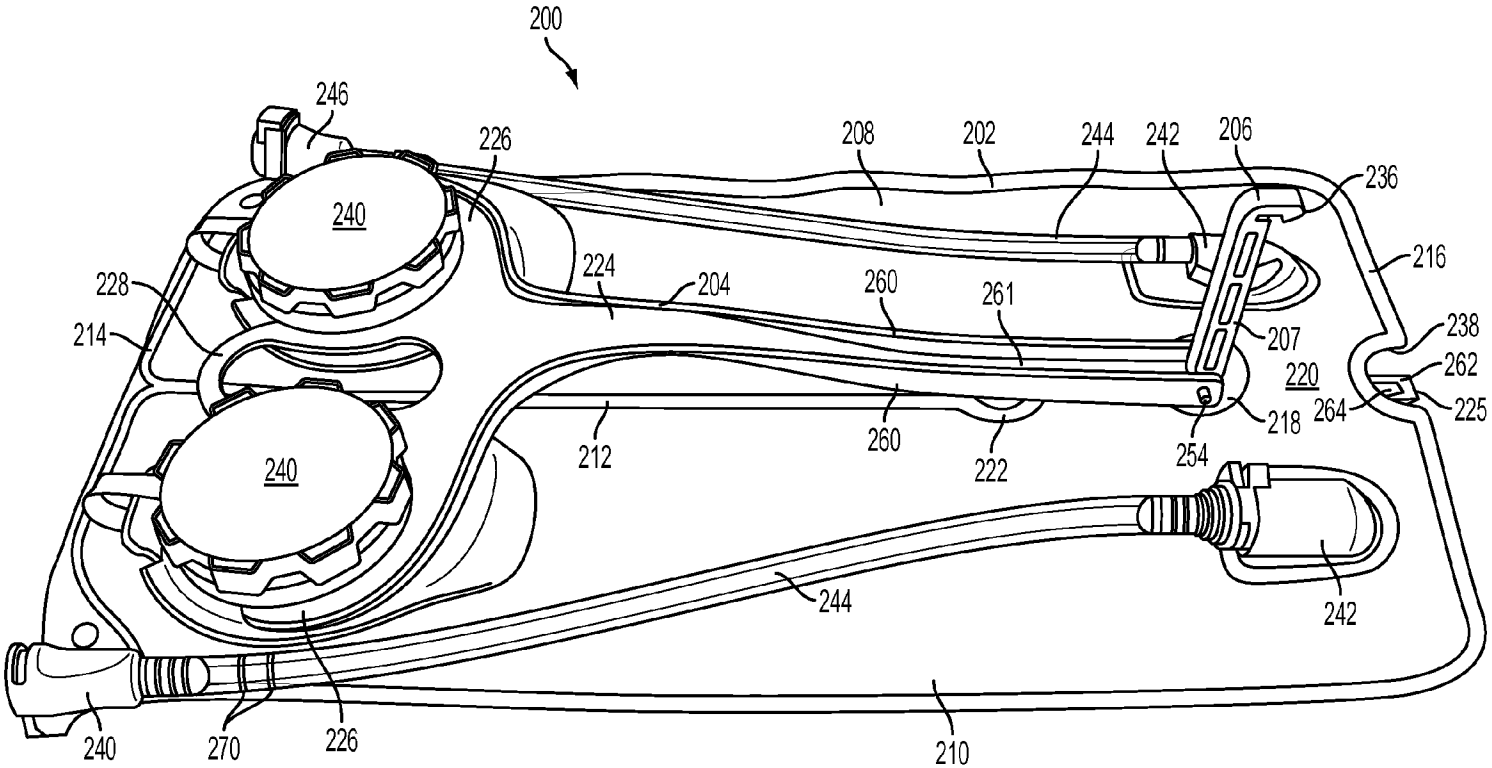
FIG. 7 is a perspective front view of the fluid container of FIG. 6, configured with the latch partially pivoted from the position of FIG. 6.
Figure 8:
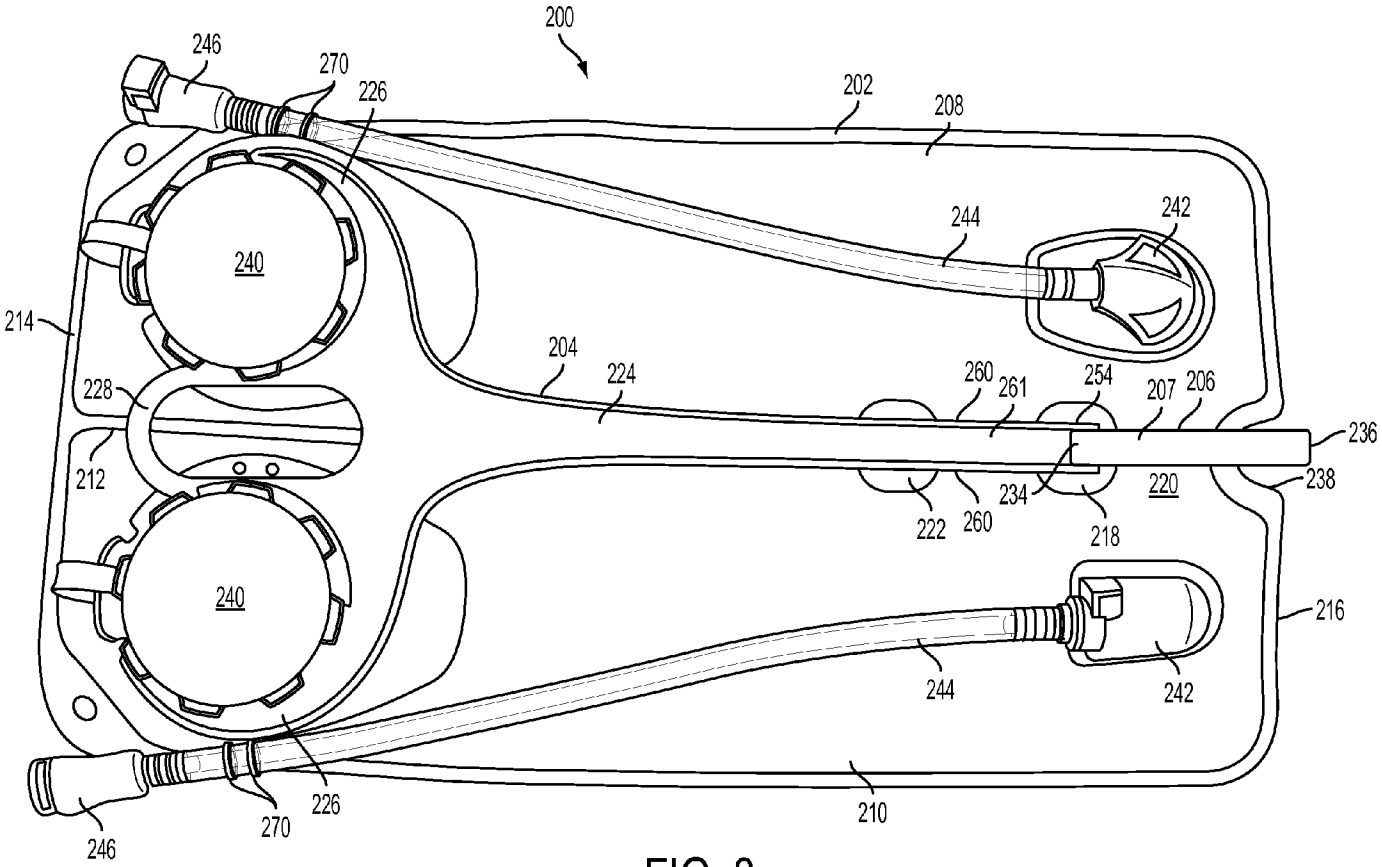
FIG. 8 is a perspective front view of the fluid container of FIG. 6, configured with the latch pivoted about 180° from the position of FIG. 6 to a closed position with the two fluid chambers fluidly separated.
Figure 9:
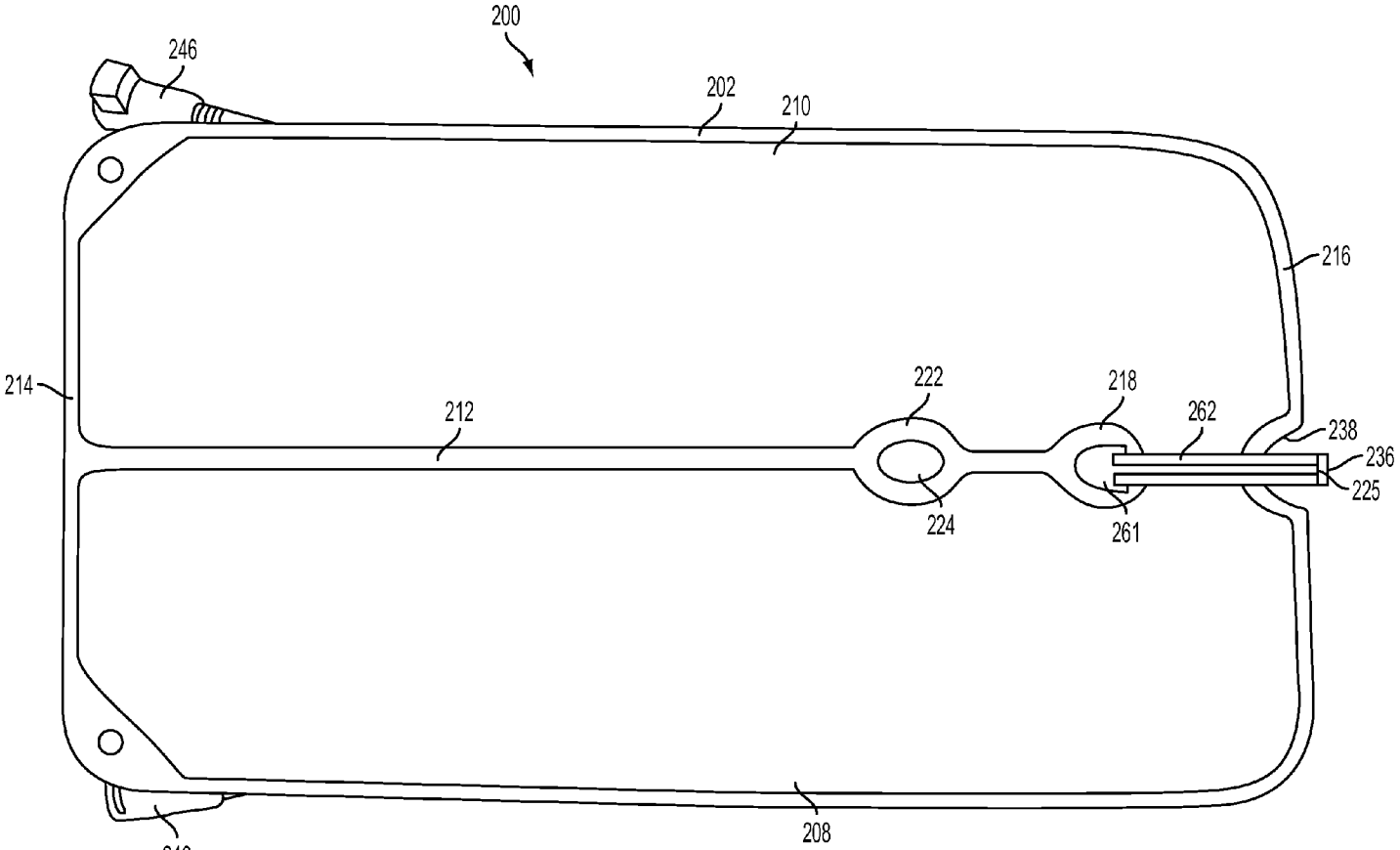
FIG. 9 is a rear view of the fluid container of FIG. 6 in the closed position of FIG. 8.

The latch 206 can be pivotable about 180° between a fully open position (not shown), with the latch nested in the upper stem portion 261 between sidewalls 260, and a closed position (FIGS. 8-9). The latch 206 has a free locking end 236 and a pivoting end 234 that is pivotably coupled to the stem portion 224 via a pivot pin 254 that extends laterally through the side walls 260 of the stem portion. FIGS. 6-7 show the latch 206 in intermediate open positions between a fully open position with the latch nested in the handle and the closed position of FIGS. 8-9. In the alternative open position shown in FIG. 6, the latch is pivoted about 30° from the fully open position.

In the closed position, the latch 206 is positioned over the passage 220 between the two chambers and seals the passage between engaged surfaces of the latch and the lower end 262 of the handle. In the closed position, the locking end 236 of the latch 206 can extend through a lower cut-out 238 in the bladder and hook around a mating surface 225 (FIG. 9) at the bottom end of the handle. This clamps the body 207 of the latch 206 against the lower end 262 of the handle to seal the bladder passage 220 therebetween such that fluid cannot flow between the two chambers 208, 210. The latch 206 can include a ridge or groove 250 (FIG. 6) that cooperates with a ridge or groove 264 (FIG. 6) in the lower end 262 of the handle to help seal the passageway 220 closed in the closed position.

The handle 204 can be removed from the bladder 204 when the fluid container 200 is used for a single fluid with the passageway 220 open, or the handle can be left attached with the latch 206 stored in the stem portion 224 in the open position. The fluid container 200 can also include fluid conduits 244 and/or drink valves 246 that are coupled to the exit ports 242. The handle 204 can optionally include retainers or other features 270 (FIG. 6) that can retain or hold the fluid conduits 244 when not in use. The handle 204 can also be used and lift and carry the fluid container 200, and to secure the fluid container to a pack or other object.

In the embodiments 100 and 200, various alternative removable handles and clips can be used and swapped out in an interchangeable manner using a common bladder. For example, the bladder 202 shown for fluid container 200 includes the upper opening 222 (FIG. 9) that is not needed with the handle 204, but is useful if the handle 104 or the clip 6 is used with the bladder 202.

In some systems, the fluid chambers can be divided is such a way such that they have unequal sizes and volumes. For example, a bladder can be dividable into two fluid chambers have a 2-to-1 volume ratio. This can allow a user to carry a larger volume of one fluid and a smaller volume of a second fluid. Accordingly, the partitioning seam and sealing device can extend across the bladder in any direction or geometry that divides the bladder into discrete chambers.

Figure 10:
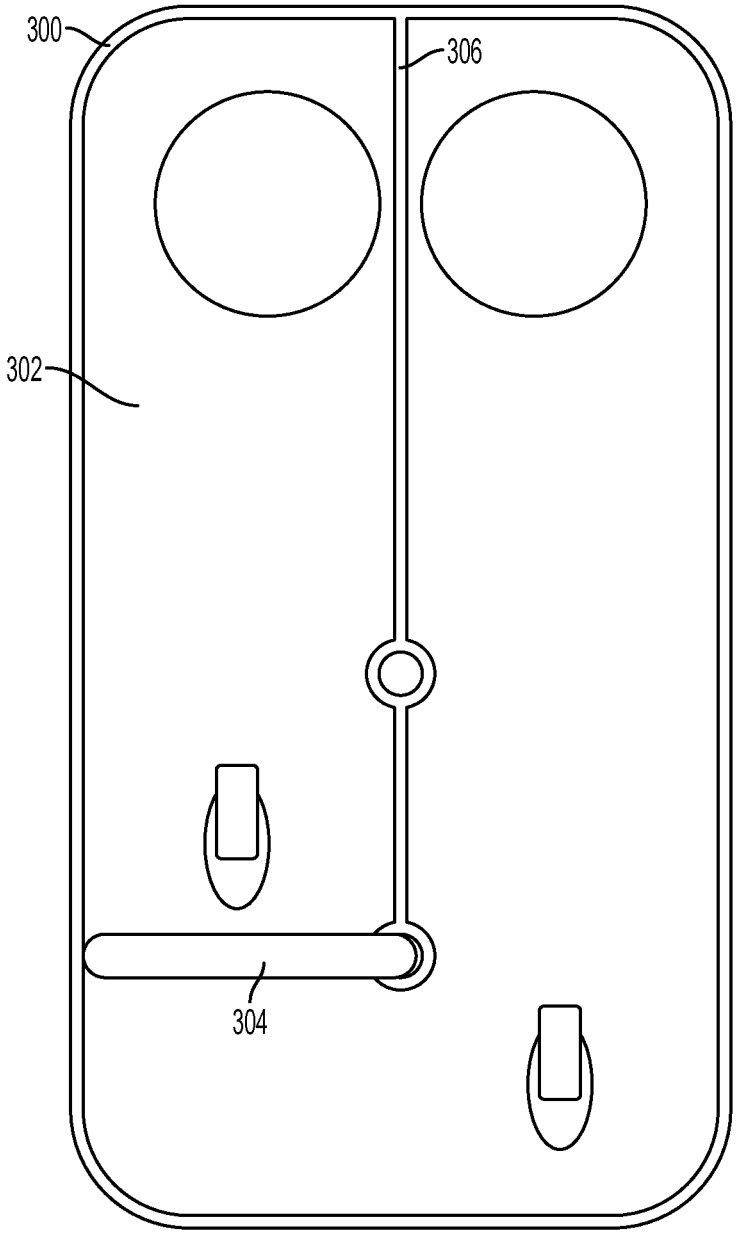
FIG. 10 is a front view of another exemplary fluid container having two fluid chambers of different sizes.

FIG. 10 shows an exemplary hydration system 300 comprising a bladder 302 with a partial portioning seam 306 and a sealing clip 304 that divide the bladder into two fluid chambers. The clip 304 can be oriented as shown in FIG. 10 extending from the bottom end of the seam 306 laterally across to the side edge of the bladder, which forms a smaller fluid chamber to the left of the seam 306 and forms a larger fluid chamber to the right of the seam and below the clip 304. The outlet port of the left-hand chamber is positioned above the clip location. Alternatively, the clip 304 can be placed extending downwardly from the bottom of the seam 306 to the bottom edge of the bladder, like in FIG. 1B, to create two equal sized fluid chambers. When the clip 304 is not in use sealing the chambers apart from each other, the clip can be removed from the bladder or stored on the bladder by clipping the clip 304 over the lower segment of the partitioning seam, like as shown in FIG. 1A.

The various bladders disclosed herein can be "soft-walled" bladders, meaning that they comprise highly pliable, flexible walls, such as comprising polymeric materials, leather, or other natural materials, which allow the bladder chambers to expand and contract as the volume of fluid in the chamber increases and decreases. In some embodiments, the bladder walls can comprise substantially elastically deformable materials to allow a degree of elastic expansion, while in other embodiments the walls are not substantially elastically deformable and define a relatively fixed maximum volume. When the chambers are empty, in some embodiments, the walls can collapse together, which minimizes the space occupied by the bladder and eliminates the need to allow air in to replace the fluid. The bladders disclosed herein can also be partially rigid-walled and partially soft-walled, such that portions of the chambers are not designed to substantially flex or bend, while other portions of the bladder are soft walled and readily bend and flex. In one such example, the majority of the fluid chambers are rigid-walled and only the area at and around the fluid passageway connecting the chambers is soft walled such that the sealing mechanism can effectively close and open the fluid passageway.

The various embodiments disclosed herein can incorporate a range of exit ports and drink tube assembly configurations. The exit ports may consist of quick connect fittings for easy drink tube removal from the bladder to aid in reservoir filling and handling. Some embodiments may include a quick connect fitting on at least one side to allow the user to temporarily remove one chamber's drink tube set when the reservoir is intended for single fluid use. The quick connect fittings may be integrated into the exit ports or into in-line couplings somewhere along the drink tube. The drink tubes may be color coded to aid in identifying the fluid type each is carrying. In backpack use, the drink tube assemblies may be configured to route to the left and right or for both to the same side. For left and right drink tube assemblies, the drink tube could end in mouthpieces designed for left and right hand use.

For purposes of this description, certain aspects, advantages, and novel features of the embodiments of this disclosure are described herein. The disclosed methods, apparatuses, and systems should not be construed as limiting in any way. Instead, the present disclosure is directed toward all novel and nonobvious features and aspects of the various disclosed embodiments, alone and in various combinations and sub-combinations with one another. The methods, apparatuses, and systems are not limited to any specific aspect or feature or combination thereof, nor do the disclosed embodiments require that any one or more specific advantages be present or problems be solved.

As used herein, the term "and/or" used between the last two of a list of elements means any one or more of the listed elements. For example, the phrase "A, B, and/or C" means "A," "B," "C," "A and B," "A and C," "B and C," or "A, B, and C." As used herein, the term "coupled" generally means physically linked and does not exclude the presence of intermediate elements between the coupled items absent specific contrary language.

In view of the many possible embodiments to which the principles disclosed herein may be applied, it should be recognized that the illustrated embodiments are only preferred examples and should not be taken as limiting the scope of the disclosure. Rather, the scope of the disclosure is defined by the following claims. I therefore claim all that comes within the scope of these claims.

The invention claimed is:

1. A multi-chambered personal hydration system, comprising:

a fluid bladder comprising at least two fluid chambers and a fluid passageway that fluidly couples the two fluid chambers within the bladder, the bladder being adapted to be worn or carried by a user; and a sealing mechanism adapted to selectively open and close the fluid passageway, such that when the fluid passageway is open the two fluid chambers function as a single fluid chamber, and when the fluid passageway is closed the two fluid chamber function as two independent fluid chambers; and wherein the sealing mechanism comprises a clip having a first jaw and a second jaw that are hingedly coupled at a hinged end and are selectively lockable together at a locking end; and wherein when the fluid passageway is open, the clip is adapted to be stored with the hinged end of the clip passing through a first opening in a partial partitioning seam between the two fluid chambers and with the locking end passing through a second opening at the partial partitioning seam, with the first and second jaws clamped against the partial partitioning seam between the first and second openings, such that the clip is retained to the bladder with the fluid passageway open.

2. The system of claim 1, wherein the bladder includes a front bladder sheet and a rear bladder sheet that are sealed together around their perimeter, and a partitioning seam that seals the front and rear bladder sheets together from a first end of the bladder perimeter between the two fluid chambers and terminates short of a second, opposite end of the bladder perimeter to form the fluid passageway, and when the sealing mechanism is in the closed position, the sealing mechanism cooperates with the partitioning seam to fluidly isolate the two fluid chambers from each other.

3. The system of claim 1, wherein each of the two fluid chambers has its own inlet port and its own outlet port.

4. The system of claim 1, wherein when the fluid passageway is closed, the clip is positioned with the hinged end at one side of the fluid passageway and with the locking end locked at an opposite side of the fluid passageway, and with the first jaw against a front wall of the bladder and with the second jaw against a rear wall of the bladder, such that the clip clamps the front and rear walls of the bladder closed to seal the fluid passageway.

5. A multi-chambered personal hydration system, comprising:

a fluid bladder comprising at least two fluid chambers and a fluid passageway that fluidly couples the two fluid chambers within the bladder, the bladder being adapted to be worn or carried by a user;

a sealing mechanism adapted to selectively open and close the fluid passageway, such that when the fluid passageway is open the two fluid chambers function as a single fluid chamber, and when the fluid passageway is closed the two fluid chamber function as two independent fluid chambers; and a rigid handle that is removably attachable to the bladder, and wherein the sealing mechanism is part of the handle.

6. The system of claim 5, wherein the handle attaches to the bladder a first location near an upper end of the bladder and attaches to the bladder at a second location near a lower end of the bladder.

7. The system of claim 5, wherein the handle comprises an upper fixed portion positioned on a front side of the bladder and a lower fixed portion that extends through an opening in the bladder and is positioned along a rear side of the fluid passageway, and the latch is pivotable about 180° between an open position wherein the latch is stored in the upper fixed portion of the handle and a closed position wherein the latch extends over the front side of the fluid passageway and locks with the lower fixed portion of the handle at a lower end of the fluid passageway to clamp the fluid passageway closed.

8. The system of claim 5, wherein the bladder includes a front bladder sheet and a rear bladder sheet that are sealed together around their perimeter, and a partitioning seam that seals the front and rear bladder sheets together from a first end of the bladder perimeter between the two fluid chambers and terminates short of a second, opposite end of the bladder perimeter to form the fluid passageway, and when the sealing mechanism is in the closed position, the sealing mechanism cooperates with the partitioning seam to fluidly isolate the two fluid chambers from each other.

9. The system of claim 8, wherein the partitioning seam comprises at least one opening that passes through both the front and rear bladder sheets to permit passage of the sealing mechanism through the opening.

10. The system of claim 5, wherein each of the two fluid chambers has its own inlet port and its own outlet port.

11. The system of claim 10, wherein the handle attaches to the inlet ports of the fluid chambers.

12. The system of claim 5, wherein the sealing mechanism comprises a latch that is pivotable relative a fixed portion of the handle.

13. The system of claim 12, wherein the latch is adapted to be stored in the fixed portion of the handle when the fluid passageway is in the open position.

14. The system of claim 12, wherein the latch is coupled to the fixed portion of the handle via a pivot pin that passes through a slot in the fixed portion of the handle, and the pivot pin and latch are allowed to translate along the slot in a front-back direction of the bladder while the latch rotates between open and closed positions.

15. The system of claim 12, wherein the latch can pivot about 360° relative to the fixed portion of the handle between an open position where the fluid passageway is open and a closed position where the fluid passageway is closed.

16. The system of claim 15, wherein a fixed portion of the handle is positioned on a front side of the fluid passageway, and wherein the latch is positioned on a rear side of the fluid passageway in the closed position such that the latch and the fixed portion of the handle clamp together to seal the fluid passageway.

* * * * *